US005914009A

United States Patent [19]

Kotitschke

[11] Patent Number: 5,914,009

[45] Date of Patent: Jun. 22, 1999

[54] DOUBLE WIRE SHEET FORMER

[75] Inventor: Gerhard Kotitschke, Steinheim, Germany

[73] Assignee: J.M. Voith GmbH, Heidenheim, Germany

[21] Appl. No.: 08/713,585

[22] PCT Filed: Aug. 18, 1994

[86] PCT No.: PCT/EP94/02752

§ 371 Date: Jun. 19, 1995

§ 102(e) Date: Jun. 19, 1995

[87] PCT Pub. No.: WO95/06162

PCT Pub. Date: Mar. 2, 1995

Related U.S. Application Data

[63] Continuation of application No. 08/424,294, Jun. 19, 1995, abandoned.

[30] Foreign Application Priority Data

Aug. 20, 1993 [DE] Germany ..... 43 28 024

[51] Int. Cl.[6] ..... D21F 1/00

[52] U.S. Cl. ..... 162/301; 162/300

[58] Field of Search ..... 162/300, 301, 162/352

[56] References Cited

U.S. PATENT DOCUMENTS

| | | | |
|---|---|---|---|
| 4,554,052 | 11/1985 | Waris | 162/301 |
| 5,045,153 | 9/1991 | Sollinger et al. | 162/301 |
| 5,078,835 | 1/1992 | Schiel et al. | 162/352 |
| 5,167,770 | 12/1992 | Bubik et al. | 162/301 |
| 5,215,628 | 6/1993 | Koivuranta et al. | 162/300 |
| 5,282,933 | 2/1994 | Bubik et al. | 162/301 |
| 5,389,206 | 2/1995 | Buck et al. | 162/301 |
| 5,599,427 | 2/1997 | Koivuranta et al. | 162/301 |

FOREIGN PATENT DOCUMENTS

| | | |
|---|---|---|
| 0438681 | 7/1991 | European Pat. Off. . |
| 0475921 | 9/1991 | European Pat. Off. . |
| 0486814 | 10/1991 | European Pat. Off. . |
| 9201722 | 1/1992 | Germany . |
| 4402273 | 1/1994 | Germany . |
| 9312291 | 6/1993 | WIPO . |

OTHER PUBLICATIONS

Das Papier; Gap Forming Technology with TWIN–Former G for Testliner and Corrugating Medium; Müller, Bubik and Schaible; Jul. 1991, pp. 347–354.

*Primary Examiner*—Karen M. Hastings
*Attorney, Agent, or Firm*—Baker & Daniels

[57] ABSTRACT

A two-wire former of a papermaking making machine has the following characteristics: (1) two continuous, loop-shaped wires (1, 2) form together an inlet gap for the paper pulp suspension; (2) a sheet forming zone has a section in which both wires are guided parallel to each other; (3) a plurality of guide rollers are arranged inside and outside both wire loops; (4) a roller (3, 4) associated to each wire loop deflects the associated wire at the beginning of the parallel section; (5) at least one of both inlet rollers (3, 4) has a circumferential area that forms no closed surface (forming roller). According to the invention, (6) both wires runs on the paper pulp-bearing section in a substantially horizontal direction; (7) the top wire is separated from the bottom wire by a separating suction box (8) with a curved surface; (8) the dewatering element (7.1) that follows the forming roller on the same side of the wire is provided with elastically suspended dewatering strips (7.3).

2 Claims, 7 Drawing Sheets

DOUBLE WIRE SHEET FORMER

This is a continuation of application Ser. No. 08/424,294, filed Jun. 19, 1995 now abandoned.

The invention concerns a double-wire sheet former of a paper machine for creating a paper web between two sandwiched wires.

Sheet formers are known in the art. Reference is made to G 92 01 722.3.

A shortcoming of the known double-wire sheet formers is that, among others because of their overall height and excessive rebuilding expense, they are poorly suited for rebuilding.

The problem underlying the invention is to present double-wire sheet formers which eliminate the disadvantage of the prior art.

This problem is solved by the features of the present invention.

A double-wire sheet forming part of a paper machine begins with a forming roll in the bottom wire and a solid-shell roll in the top wire. The forming roll may be or may not be equipped with suction. Both rolls form jointly a gap. Top and bottom wire wrap jointly around the forming roll on an arc of 30 to 65°. A machinewide stream of suspension injects into the gap formed by the breast roll and the forming roll and, due to wire pressure and vacuum, is partly dewatered by both wires, creating two uniformly formed external layers. The water issuing out of the outer wire is by a stream guide trough channeled into a chute, backed by vacuum. The two wires proceed approximately horizontally after the forming roll.

The further sheet formation takes place in a turbulence section formed by a vacuum box with individual slats and a forming box in the bottom wire. The forming box is fitted with individual forming slats adapted for pneumatic contacting.

The two wires are separated in known fashion by a curved suction separator. The bottom wire after the suction separator resembles a fourdrinier wire with a suction flatbox, wire suction roll and wire drive roll.

A fundamental, common characteristic of all proposed sheet formers is an essentially horizontal arrangement of the sheet forming zone, making them in their illustrated form particularly suited for replacement of existing fourdrinier wires or for rebuilding an existing fourdrinier wire to a double-wire former.

BRIEF DESCRIPTION OF THE DRAWINGS

For detail explanation, embodiments are illustrated in FIG. 1 through 7.

DETAILED DESCRIPTION

Figure 1:
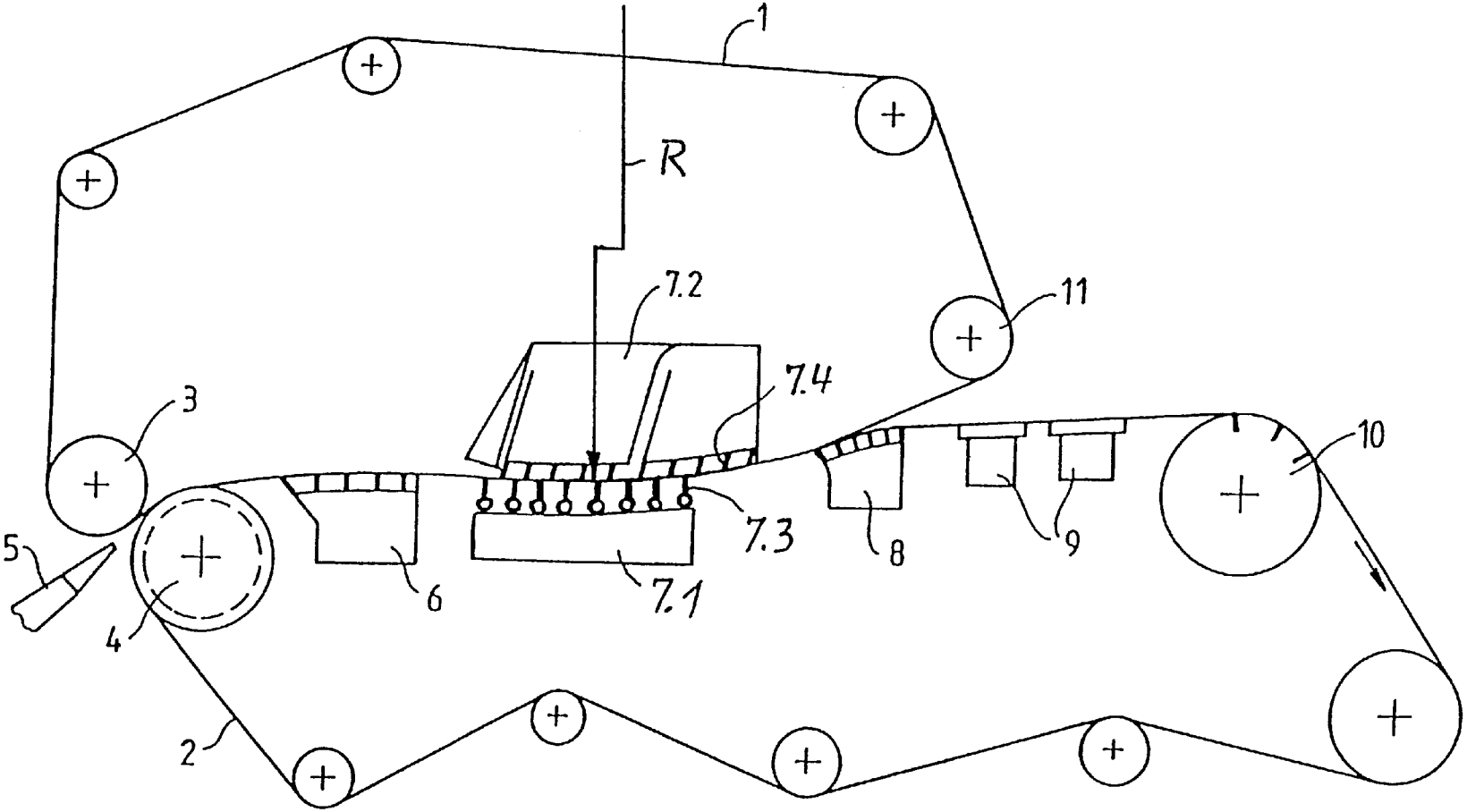

FIG. 1 shows a fourdrinier wire rebuilt into a double-wire sheet former with the lower revolving wire 2 and, arranged so as to lie above it, the wire 1 revolving above. The wire 1 is deflected over several deflection rolls and passed to a first breast roll 3 which is situated approximately at an angle of 45° to the left and above the first entry roll 4 of the bottom wire 2, which is fashioned as a forming roll. Between the roll 3 and roll 4, the stock suspension is injected by the headbox between the wires 1 and 2. Following the roll 4, a first dewatering shoe 6 having a slight curvature corresponding to the roll 4 is arranged on the side of the wire 2. Following the forming shoe 6 is a double dewatering unit 7.1 and 7.2, for example according to the U.S. Pat. No. 5,045,153 (P 4713), the dewatering unit 7.2 being a suction box with a plurality of rigid slats 7.4 that are situated on the side of wire 1. Arranged opposite from it is the dewatering unit 7.1, which is equipped with a plurality of dewatering slats 7.3 that are staggered relative to the opposing slats 7.4 of unit 7.2. Essential is that at least part of the slats 7.3 of unit 7.1 are supported by means of flexible elements, for instance springs or pneumatic pressure cushions (as indicated schematically) and that, preferably, each individual slat can be forced down on the wire 2 with a selective force. Reference is made to the U.S. Pat. No. 5 078 835 (P 4734). The radius of curvature in the center of wire units 7.2 and 7.1 is situated on the other side of the wires, relative to the radius of curvature of the wire unit 6. Following the wire units 7.1, 7.2, a separating unit with opposite curvature, in the form of a suction shoe, is arranged again on the side of wire 2. Separating from the web in the area of shoe 8, the wire 1—proceeding over a deflection roll 11 and further deflection rolls—returns to the first roll 3 of this wire loop. On the side of wire 2, following the separating shoe 8, two suction flat-boxes 9 are arranged, for example, which bring about a further dewatering of the fiber web and pass the wire on to a further suction roll 10, whence the wire 2 proceeds again, over several deflection rolls, back to the first forming roll 4, while the fiber web is picked up directly at or after the roll 10.

Figure 2:
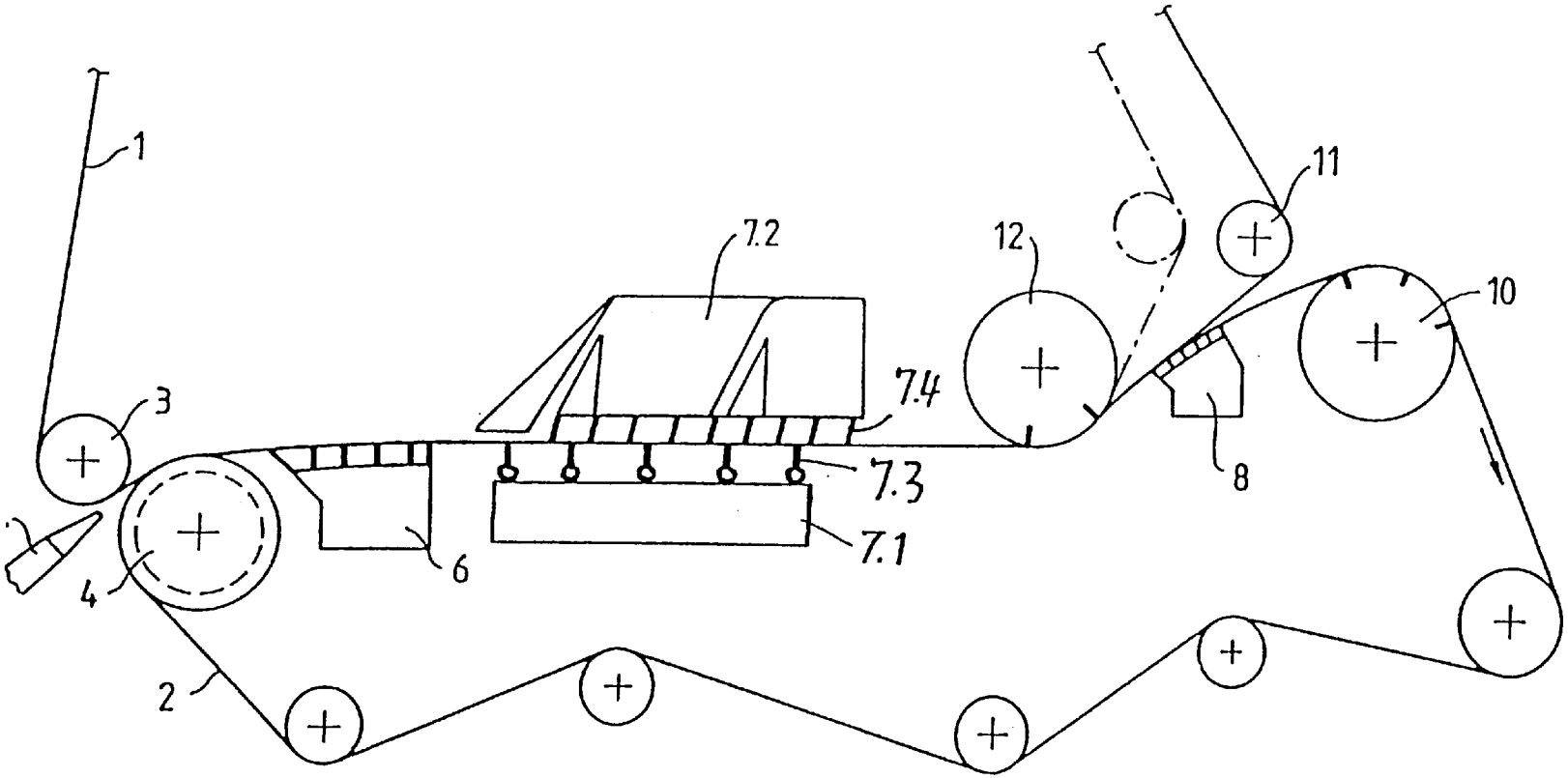

FIG. 2 shows a double-wire sheet former similar to FIG. 1, where the starting phase from the headbox to the dewatering units 7.1 and 7.2 is basically the same, except for the fact that the dewatering units 7.2 and 7.1 do not possess a curvature. The dewatering unit 7.2 is then followed, on the same wire side, by a suction guide roll 12 which deflects the double wire upwardly. Following thereafter, on the opposite side, is the wire separating device 8 in the form of a curved suction shoe on which the wires separate, with wire 1 being deflected upwardly again over a deflection roll 11, while wire 2—along with the formed fiber web—proceeds to a further suction roll 10 and, again over several deflection rolls, back to the roll 4, with the fiber web having been picked up from the wire 2 previously.

A further embodiment of the double wire former shown in FIG. 2 is depicted in broken lines. In this second embodiment the upper wire is separated directly by the suction guide roll 12.

In both of the embodiments shown in FIG. 2, the upper wire is separated before the further suction roll 10. Therefore, the upper wire does not wrap around the further suction roll 10. Furthermore, the suction roll 10 is positioned at a higher vertical elevation than the forming roll 4.

The upper apex of the further suction roll 10 is situated in a vertical elevation about one diameter of suction roll 10 away from a horizontal plane defined by the upper apex of the forming roll 4 and the lower apex of the suction roll 12.

This embodiment provides numerous advantages. Since the suction roll 10 is in an elevated position, it is possible to also place the pick-up roll for the press section in an elevated position. This provides for additional space, e.g., for the arrangement of a double felt press being part of the press-section following the forming section. This provides for more design possibilities in the press-section.

Since the upper and the lower wire are not separated by a flat suction box, the abrasion of the lower wire is minimized.

Furthermore, suction roll 12 is a fixpoint for the upper wire as well as for the lower wire. Therefore, the two wires have no or only a very low difference in speed giving rise for a very low wire abrasion in those parts of the wire not totally coated with suspension.

Figure 3:
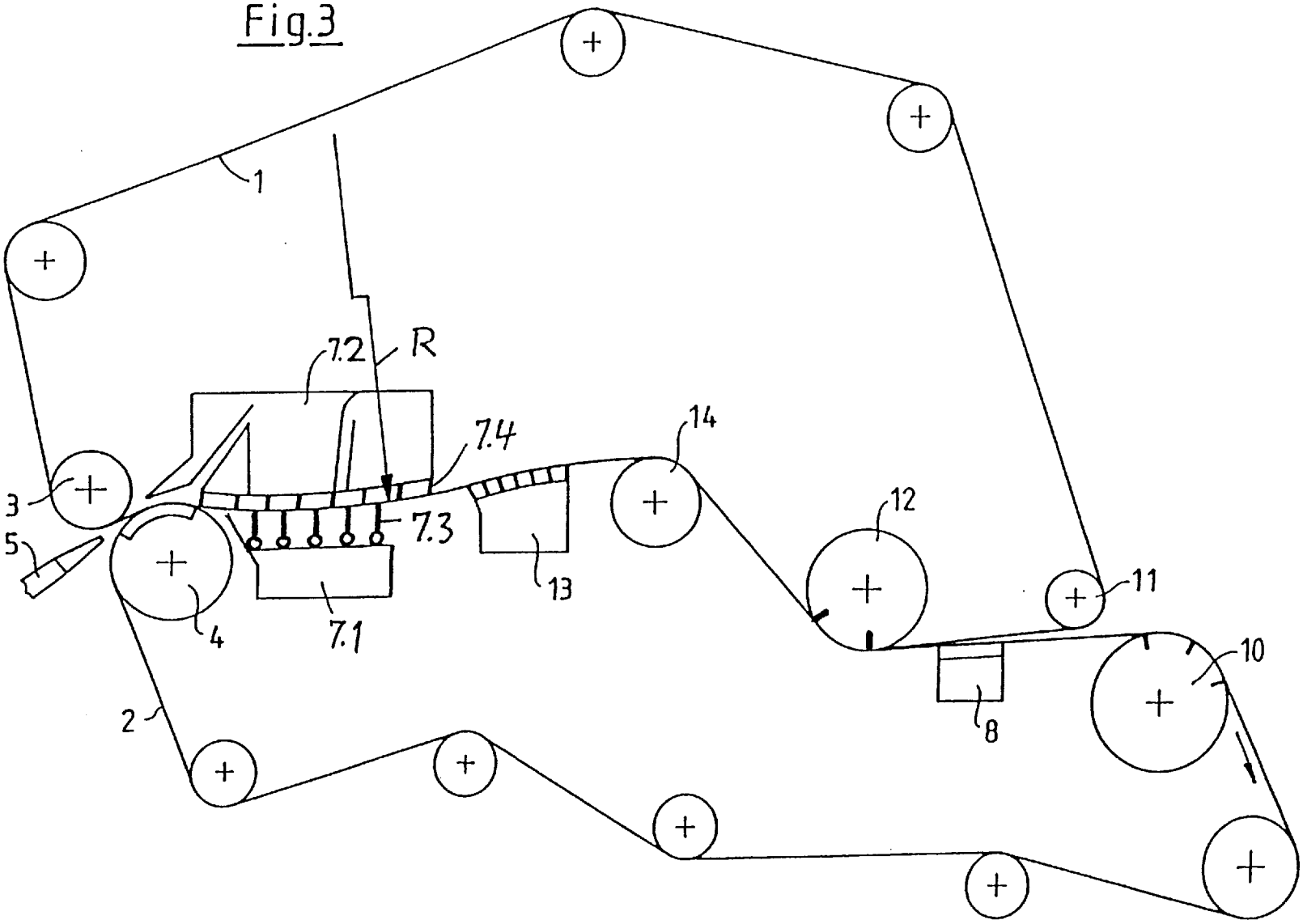

FIG. 3 shows a double-wire sheet former with a first, top wire 1 and a second, bottom wire 2. Both wires form a gap, with the wire 1 being deflected by a guide roll 3 in horizontal direction, whereas the wire 2 deflects over a forming roll fashioned as suction roll to the horizontal. A headbox 5 injects the stock suspension into the gap between wires 1 and 2. Forming roll 4 is followed immediately by a double-sided dewatering element whose curvature is opposite to that of roll 4, with the dewatering element 7.2 located within the loop of wire 1 being fitted with fixed dewatering slats and suctioned via a vacuum, whereas the opposite dewatering element 7.1 is provided with dewatering elements which at least in part are suspended elastically. Element 7.1 is followed by another dewatering shoe 13 which curves oppositely and passes the double wire to a deflection roll 14 located on the same side, whence the double wire proceeds to an opposite suction roll 12 which, in turn, is followed by a separating element 8 which is situated on the side of the wire 2 and separates the wire 1 from the fiber web carried on the wire 2, to return then, via a deflection roll 11 and passing over further deflection rolls, to the roll 3, whereas the wire 2—along with the fiber web—proceeds over a suction guide roll 10, whereafter the wire 2, upon separation of the web, returns again via several deflection rolls to the roll 4.

Figure 4:
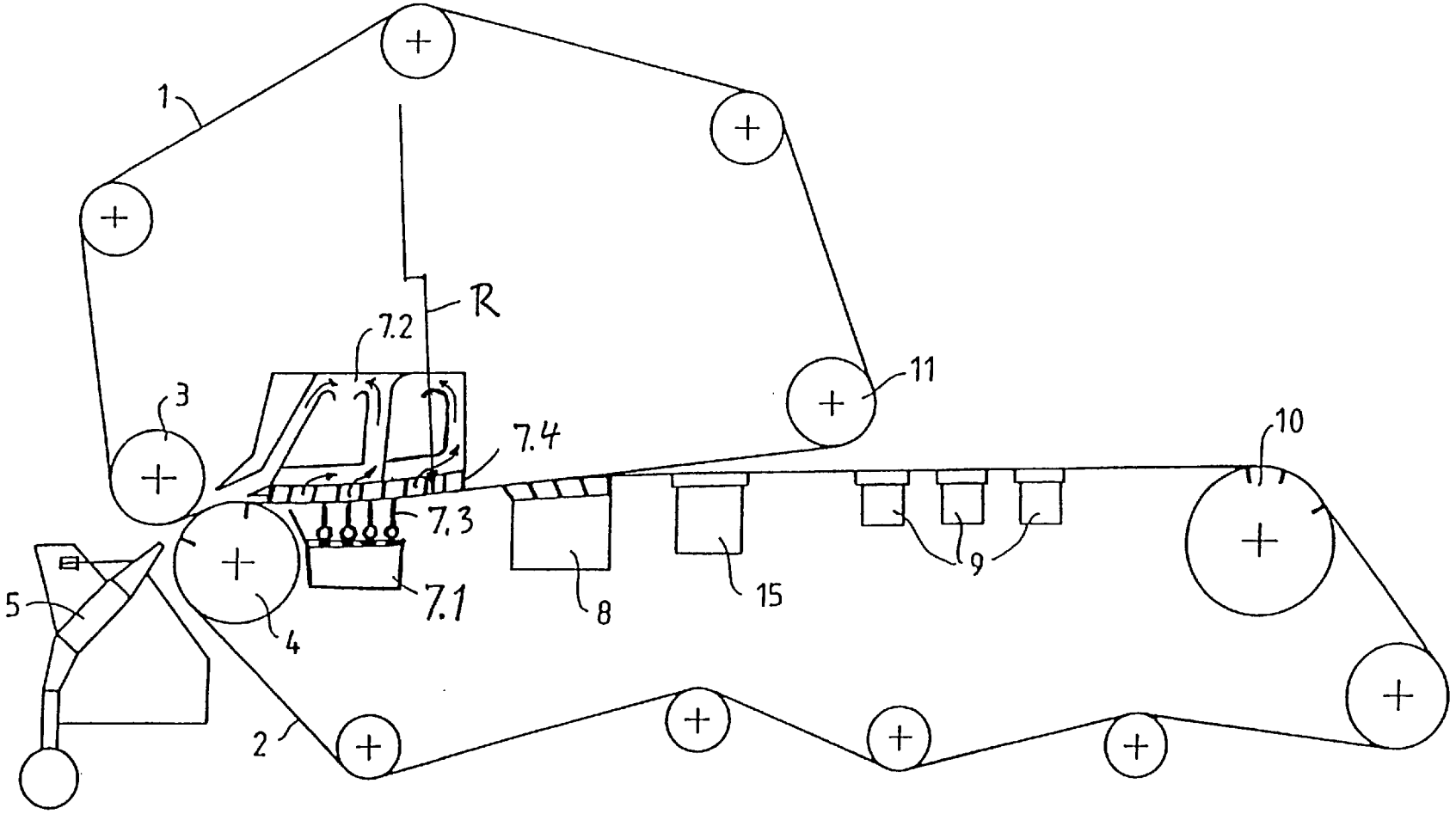

FIG. 4 shows a double-wire sheet former which initially corresponds to FIG. 3, but where the wire separation takes place with the aid of the separating device 8, directly after the double-sided dewatering by way of dewatering devices 7.2 and 7.1. Upon separation, the wire 1 returns again—via roll 11 and further deflection rolls—to the entry roll 3, whereas the wire 2, along with the fiber web carried on it, proceeds horizontally and is dewatered by several suction boxes 15 and 9 that are arranged on the side of the wire 2, whereafter the wire 2 is deflected again via suction roll 10. Behind suction roll 10, the fiber web is picked up and the wire 2 returns via several deflection rolls to the forming roll 4.

Figure 5:
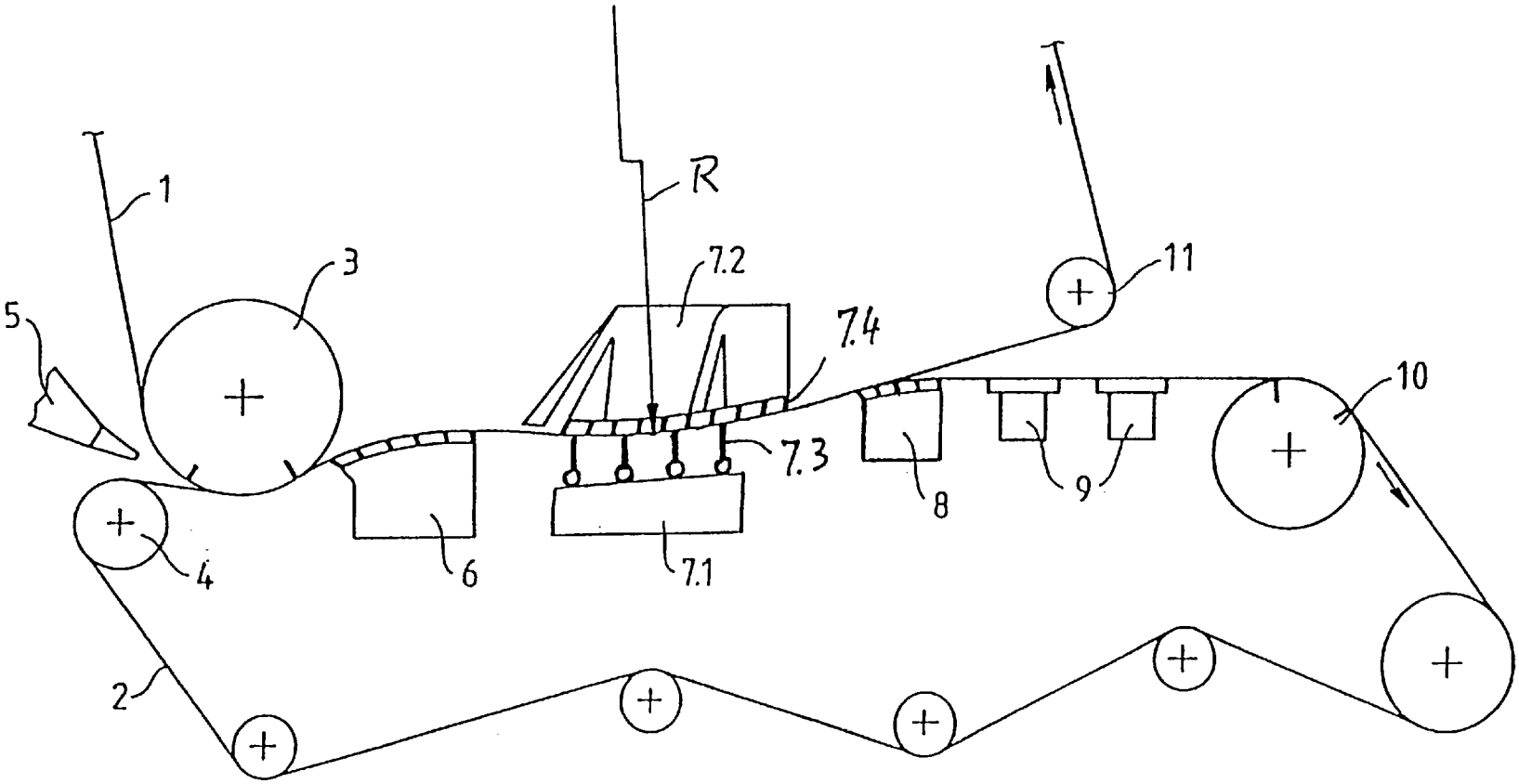

FIG. 5 shows a double-wire sheet former with a revolving first, top wire 1 and a revolving second, bottom wire 2. Coming from below, the wire 2 transfers via breast roll 4 into the horizontal, while wire 1—coming from above—passes over an upper forming roll fashioned as a suction roll. Along with the wire 2 coming from deflection roll 4, the forming roll forms a gap into which the stock suspension is introduced by the headbox 5. Arranged on the side opposite the suction and forming roll and following it is a curved forming shoe 6, the curvature of which is fashion opposite to that of forming roll 3. The following dewatering elements 7.2, 7.1 etc. correspond to the style according to FIG. 1.

Figure 6:
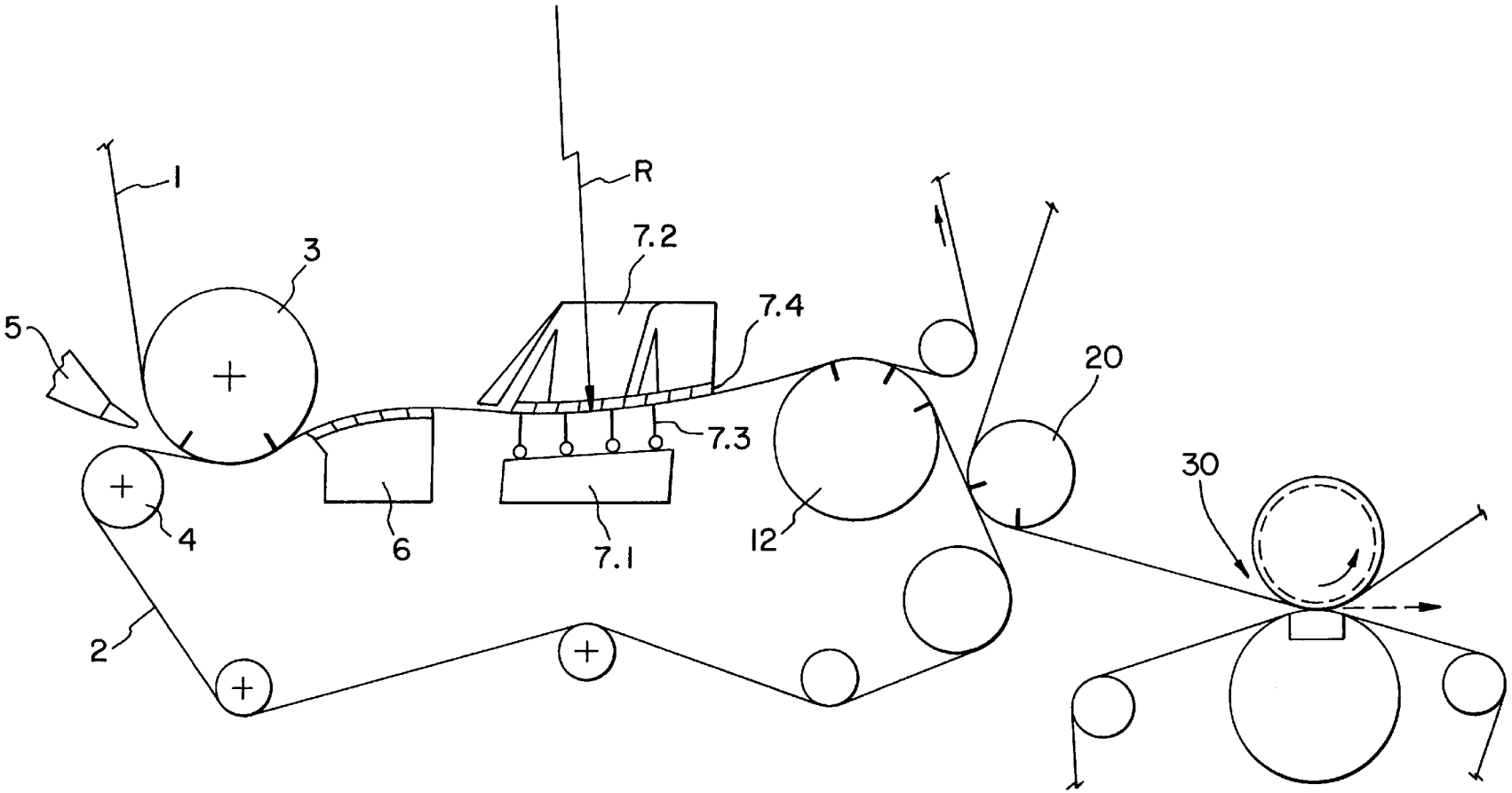
Figure 7:
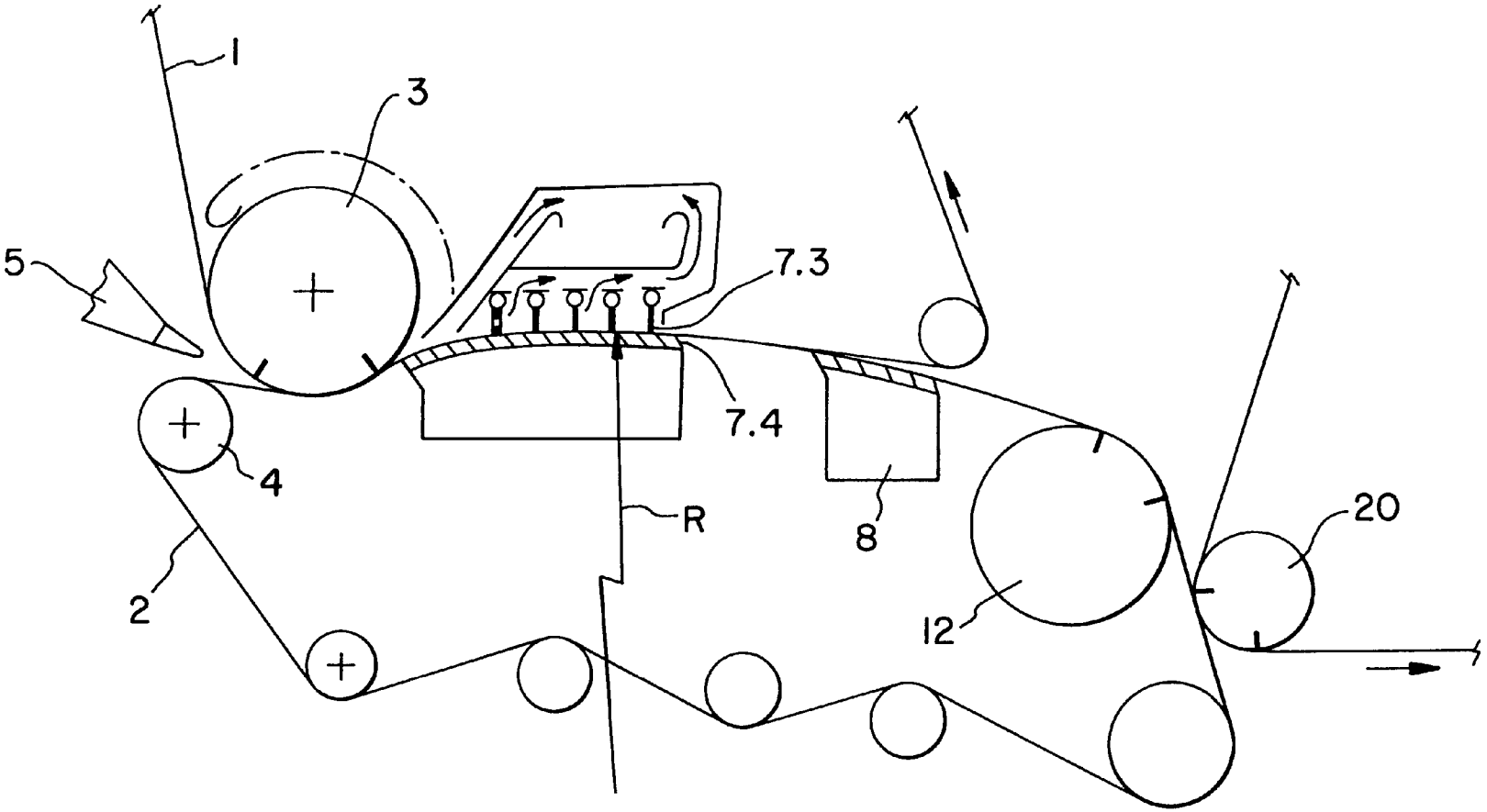

FIGS. 6 and 7 illustrate special embodiments of the twin wire former depicted in FIG. 5.

The twin wire former according to FIG. 6 comprises a suction roll 12 as a separating device. The bottom wire is separated from the top wires by travelling along the circumference of the suction roll 12. The paper web travels along with the bottom wire and is transferred by a further suction roll 20 to the pressing section 30 of the paper machine.

FIG. 7 is an alternative embodiment of the apparatus in FIG. 5 in which the suction boxes are omitted and the flexible dewatering slats 7.3 are arranged within the suction box 7.2. This arrangement allows for better cleaning of the flexible dewatering slats, due to the fact that the dewatering slats are totally covered by the water that stands in the lower part of the vacuum box 7.2.

I claim:

1. A double-wire sheet former of a paper machine, comprising:

two revolving, looping wires arranged to define an entry gap for a paper stock suspension, said revolving looping wires comprising respective top and bottom wires and further defining a sheet forming section wherein said two wires run generally parallel to each other, said wires in the sheet forming section being substantially horizontal;

a respective entry roller positioned within each one of said two wire loops, each entry roller situated at an entrance portion of said sheet forming section for deflecting a separate one of said wire loops, the entry roller positioned within the bottom wire loop comprising a forming roller having a non-continuous circumferential surface area;

a suction forming device positioned within the bottom wire loop;

a dewatering element positioned within the bottom wire loop following the suction forming device along the direction of travel of the wire, said dewatering element including elastically suspended dewatering slats;

a suction guide roll positioned within the upper wire loop and following the dewatering element along the direction of travel of the web;

a stationary suction separator device positioned within the bottom wire loop following the suction guide roll along the direction of travel of the wires for separating the top wire from the bottom wire, said stationary suction separator device having a curved surface; and a suction roller positioned within the bottom wire loop following the suction separator device along the direction of travel of the wire, said suction roller being positioned at a higher vertical elevation than said forming roller, wherein said suction roller has an upper apex, said upper apex being situated in a vertical elevation about one diameter of said suction roller away from the horizontal plane defined by an upper apex of the forming roller and a lower apex of the suction guide roll.

2. The double-wire sheet former of claim 1, wherein said forming roller positioned within the bottom wire loop comprises a suction roll.

* * * * *